United States Patent [19]

Horwinski

[11] 4,261,323

[45] Apr. 14, 1981

[54] GRATE AND STOVE HEATING UNIT

[75] Inventor: Elwood R. Horwinski, Cheshire, Conn.

[73] Assignee: Automobile Corporation of America, New Haven, Conn.

[21] Appl. No.: 29,570

[22] Filed: Apr. 12, 1979

Related U.S. Application Data

[60] Division of Ser. No. 833,816, Sep. 16, 1977, Pat. No. 4,149,517, which is a continuation-in-part of Ser. No. 648,316, Jan. 12, 1976, Pat. No. 4,050,441.

[51] Int. Cl.[3] ..... F24B 7/00; F23H 13/00

[52] U.S. Cl. ..... 126/63; 126/66; 126/165

[58] Field of Search ..... 126/121, 122, 131, 132, 126/139, 164, 163 R, 61, 63, 66, 77, 72; 237/51, 55

[56] References Cited

U.S. PATENT DOCUMENTS

| | | | |
|---|---|---|---|
| 3,911,894 | 10/1975 | Richard, Jr. et al. | 126/121 |
| 3,981,292 | 9/1976 | Lilly | 126/121 |
| 4,026,263 | 5/1977 | Boyd | 126/121 |
| 4,173,966 | 11/1979 | Scharen | 126/121 |

*Primary Examiner*—James C. Yeung

*Attorney, Agent, or Firm*—H. Gibner Lehmann; K. Gibner Lehmann

[57] ABSTRACT

A high efficiency grate and stove heating unit for extracting useful heat from a fire, comprising in combination a low metal enclosure having an expansive top wall constituting a grate proper for supporting fireplace logs and the coals resulting therefrom, together with multiple heat exchangers in the form of plates or corrugation ribs on the top wall and means to cradle the logs thereof. Other plates or corrugation ribs extend downward from the top wall, and the plates can abut the bottom enclosure wall to constitute a reinforcement means. In one embodiment of the invention the enclosure includes an air inlet port connected with an electric blower for forcing air into the enclosure, together with multiple outlet ports from which the air, now heated, flows. A series of forward protruding nozzles is carried by the enclosure and communicates with the outlet ports to channel the heated air in directions away from the enclosure and its inlet port. Disposed between the blower and the fire area is a heat shield that intercepts radiant heat from the fire, which would otherwise impinge on the blower and cause over-heating of the same. The ribs or plates extending downward from the top wall of the grate form of enclosure constitute a series of internal compartments, and force the circulating air to follow tortuous or circuitous paths. In a preferred embodiment of the invention, the blower simultaneously pressurizes all the compartments, with each of the latter in turn communicating with one of the enclosure's outlet ports.

8 Claims, 16 Drawing Figures

Fig. 1
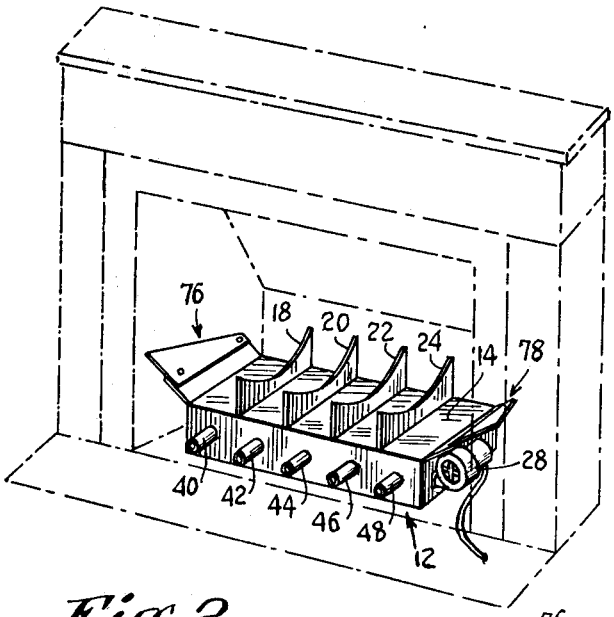
Fig. 2
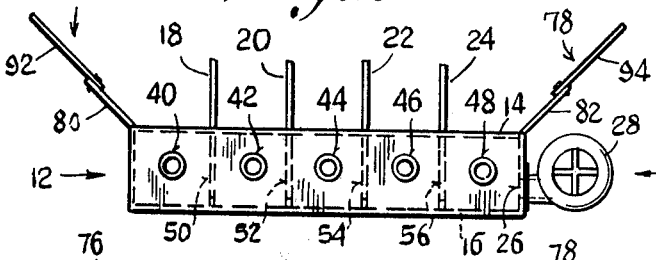
Fig. 5
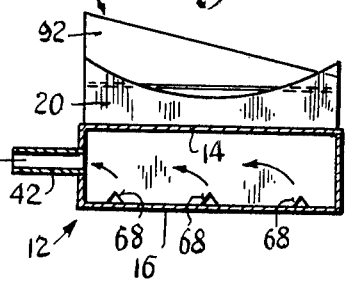
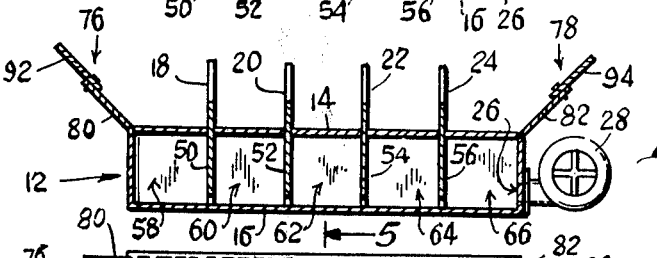
Fig. 4
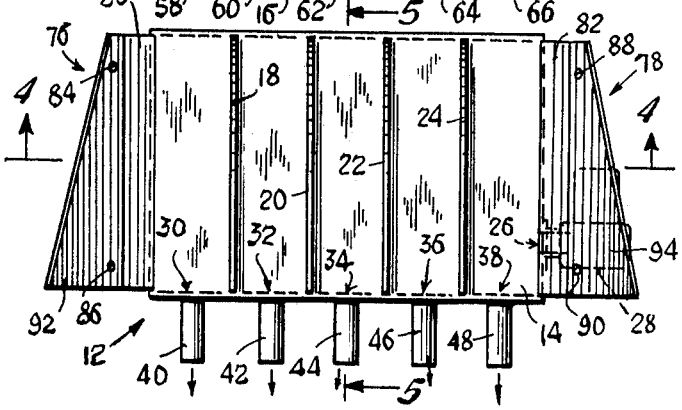
Fig. 3

Fig. 6
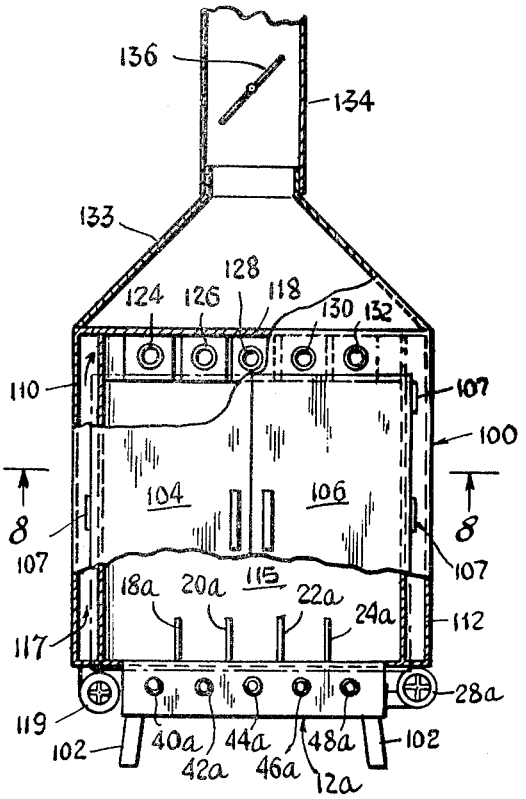
Fig. 7
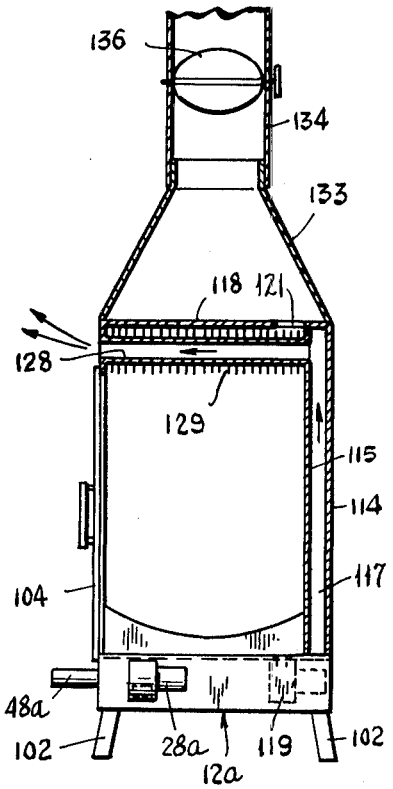
Fig. 8
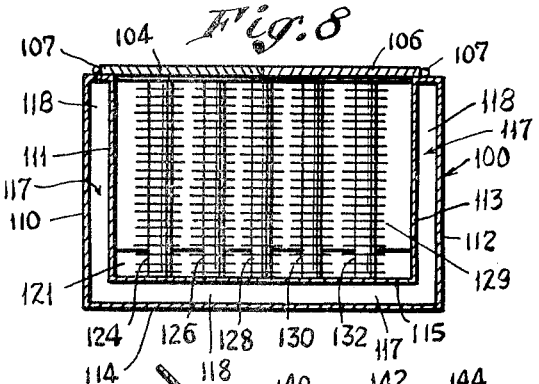
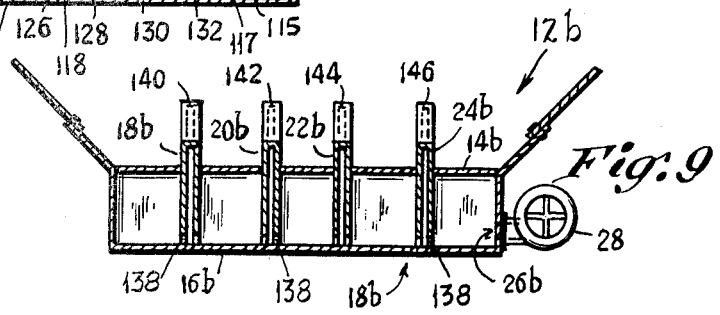
Fig. 9

Fig. 12
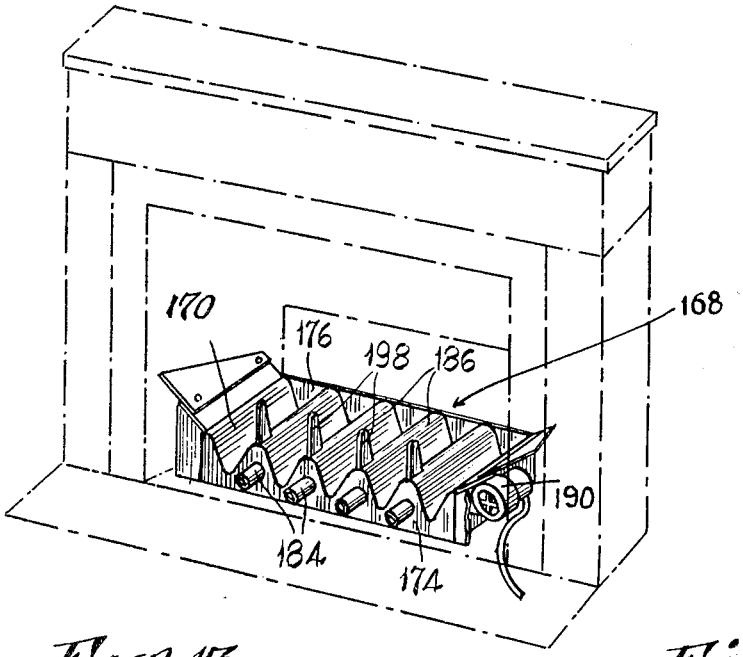
Fig. 13
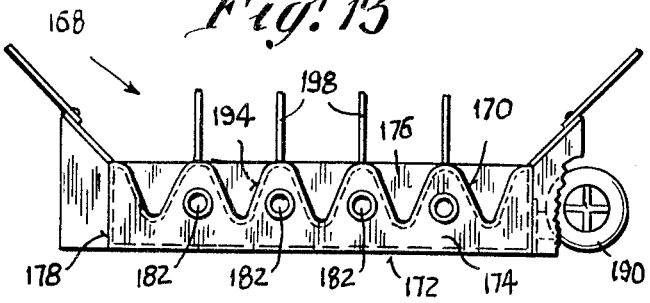
Fig. 16
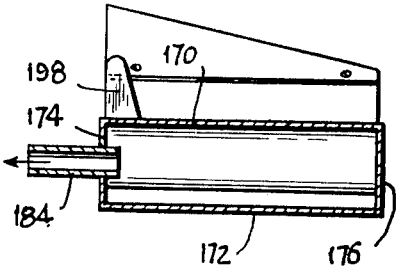
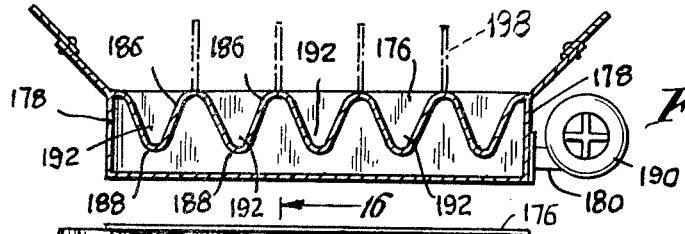
Fig. 15
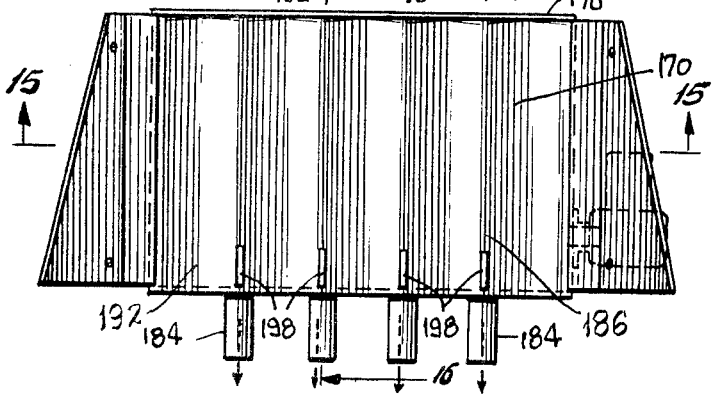
Fig. 14

GRATE AND STOVE HEATING UNIT

This is a division, of application Ser. No. 833,816, filed Sept. 16, 1977, Pat. No. 4,149,517 which application was C-I-P with prior application, Ser. No. 648,316 filed Jan. 12, 1976, Pat. No. 4,050,441.

BACKGROUND

This invention relates generally to domestic wood or coal heaters such as fireplace grates, stove grates, stoves and the like, and more particularly to grates and stoves wherein a forced convection of the exchanger fluid is employed to increase the heating efficiency.

Typically, the heating efficiency of a conventional fireplace or stove is extremely low for two reasons. First, the heat represented by the smoke and vapors is largely lost up the chimney. Second, the updraft in the chimney draws cold air from outside the house to filter into the room through the cracks in the doors and window casings, the cold air partially replacing the relatively warmer air occupying the room. In the past, many attempts have been made to increase the efficiency of fireplaces and stoves by extracting more of the waste heat and circulating it into the room. In some systems, this has taken the form of multiple convection channels in the brick surrounding the fireplace itself, both with and without auxiliary forced air equipment. Several manufactures have developed gratings constituted of multiple U-shaped lengths of tubing disposed side by side, such that air could circulate through the tubes by natural convection. Many of these had complicated or difficult shapes and were costly to manufacture, being thus only moderately successful. Still other devices employed hollow tubing with forced convection, but these latter suffered from the drawback that only a limited area of the convectors was actually in contact with the glowing coals, which actually represent a large portion of the heat available from the fire. Accordingly, the efficiency of such systems, while better than that of an ordinary fireplace, still tended to be rather low.

Conventional open-fire stoves depended on natural convection to distribute their heat, and in consequence the area surrounding the stoves was overly hot whereas areas remote from the stove were too cold. Also, there was lacking the capability of circulating heated fluid from upper, lower and wall portions of the stove fire box, which portions received considerable heat by convection and radiation.

SUMMARY

The above drawbacks and disadvantages of prior open-fire convection systems are obviated by the present invention, which has for an object the provision of a novel and improved, high-efficiency forced-fluid heating unit which is simple in construction, reliable in operation, and which exhibits increased efficiency due to large surface areas being available for contact with the logs and coals. A related object of the invention is the provision of an improved heating unit as above, wherein the parts are constituted either of structural iron or else as simple castings or both, which can be welded together to form a sturdy unit that is highly resistant to heat damage and especially rugged, thereby to provide a long and useful service life. Still another object of the invention is the provision of a forced air and convection unit as above characterized, which features an electric blower and has a protective heat shield that intercepts those radiations from the fire which otherwise could cause undesirable heating of the blower and possible subsequent failure thereof. Yet another object of the invention is to provide an improved open-fire stove having a forced convection system embracing a supporting fire box unit on which the fire rests, and also embracing a stove top circulator adapted to operate with either an air or liquid medium.

The above objects are accomplished by the provision of a unique convection unit adapted for extracting heat from a fire, comprising a relatively low metal enclosure having liquid or air inlet ports and single or multiple air or liquid outlet ports, and having an expansive top wall constituted as a grate and which is either finned or currugated and adapted to hold fire logs and coals resulting therefrom; one embodiment has multiple, upwardly-extending heat-collector fins or plates carried by the top wall for intimate contact with the coal. Another embodiment has a corrugated top wall constituting the grate. A forced fluid or air impeller connected with the enclosure and coupled to an inlet port forces fluid into the same. Heat collecting fins or plates within the enclosure transfer the collected heat to the fluid and also reinforce the top enclosure wall to prevent downward warping or buckling. In one embodiment multiple nozzles are carried by enclosures in the form of a grate and stove combination, the nozzles communicating with outlet ports for directing heated air into the room in directions away from the enclosure and impeller. A heat isolating shield is also carried by the grate enclosure and disposed between the fire area where the coals are held and the impeller, to block radiant heat which would otherwise impinge on the impeller casing and cause possible premature failure thereof. The arrangement is such that due to the large surface areas of the enclosure and heat exchanger plates or corrugations, which are available for intimate contact with the fire and coals, together with the heat conduction and forced fluid circulation associated therewith, greatly increased efficiency is realized, all without requiring any physical alteration or modification of an existing fireplace facility.

Other features and advantages will hereinafter appear.

In the drawings illustrating the several embodiments of the invention:

FIG. 1 is a perspective view of the improved convection grate unit of the present invention, particularly illustrating the upstanding heat exchanger and log support fins or plates thereof, as adapted for use in a typical fireplace.

FIG. 2 is a front elevational view of the grate unit of FIG. 1.

FIG. 3 is a top plan view of the grate unit of FIGS. 1–2.

FIG. 4 is a vertical section taken on line 4—4 of FIG. 3.

FIG. 5 is a vertical section taken on line 5—5 of FIG. 3.

FIG. 6 is a view, partly in front elevation and partly in vertical section, of a stove employing a grate unit similar to that of FIGS. 1–5, the stove being adapted to extract heat from the coals of the fire and also from the flames thereof.

FIG. 7 is a view, partly in side elevation and partly in vertical section, of the stove FIG. 6.

FIG. 8 is a section taken on line 8—8 of FIG. 6.

FIG. 9 is a view like that of FIG. 4 but showing a modified convection unit employing hollow heat exchanger fins, constituting another embodiment of the invention.

Figure 10:
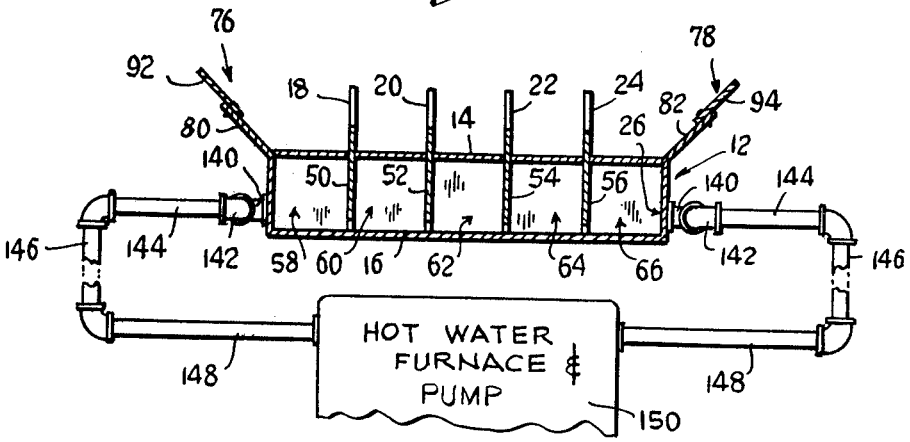
FIG. 10 is a vertical sectional view of a grate unit illustrating another embodiment of the invention, adapted for use with a hot water heating system.

The section is taken through the heat-exchanging head or top zone of the stone, which is that area defined later in the specification in connection with FIGS. 6–8.

FIGS. 12 is a perspective view like that of FIG. 1 but illustrating another embodiment of the invention.

FIG. 13 is a front elevational view of the grate unit of FIG. 12.

FIG. 14 is a top plan view of the grate unit of FIGS. 12 and 13.

FIG. 15 is a vertical section taken on line 15—15 of FIG. 14.

FIG. 16 is a vertical section taken on line 16—16 of FIG. 14.

Referring first to FIGS. 1–5, in accordance with the present invention there is provided a novel and improved, high-efficiency heat-extracting forced draft grate unit for a fireplace, comprising a low box-like enclosure 12 having co-extensive top and bottom walls 14, 16 preferably constituted of thick sheet metal, such as heavy ¼ inch boiler plate, and a plurality of upstanding heat collector fins or plates 18, 20, 22 and 24 of thick sheet metal all of which are preferably welded to the top wall and disposed in spaced relation with one another. As shown, the plates 18-24 have at their tops a scalloped configuration for cradling logs which are placed on the enclosure 12, and the latter includes an inlet port 26 to which there is attached an electric blower 28 of roughly 100 CFM capacity for forcing air therethrough. Also provided on the enclosure 12 is a plurality of outlet ports 30, 32, 34, 36 and 38 which preferably have nozzles in the form of tubular extensions 40, 42, 44, 46 and 48 respectively. The nozzle direct heated air from the compartments formed in the enclosure 12 in directions away from the latter and away from the inlet port 26.

Referring to FIG. 4 there is shown, extending between the top and bottom walls 14, 16 of the enclosure 12, a series of heat dissipating and support fins or plates 50, 52, 54 and 56 welded to the top wall and dividing the enclosure into several compartments 58, 60, 62, 64 and 66. The plates 50–56 each have notches 68 which provide communication between the compartments 58–66 and the inlet port 26. In the embodiment shown, each of the outlet ports communicates respectively with one of the compartments 58–66 for providing an even heat distribution and air flow through the enclosure 12. By virtue of the fact that the nozzles are near floor level when the unit is installed, air therefrom is forced outward toward the center of the room and rises gradually as it travels, resulting in a generally uniform distribution of heat throughout the room.

The dissipating plates 50-56 rest on the bottom wall 16 of the enclosure and constitute reinforcements which prevent the top wall 14 from buckling or warping downward. This is an important feature of the invention, making for durability and ruggedness of the unit.

Referring now to FIG. 4, extending angularly upwardly from the top wall 14 of the enclosure 12 are angle-shaped wings 76, 78 which are adjustable in length or extent so as to be capable of engaging the sloping walls of a fireplace. The wings respectively comprise first sections 80, 82 welded to the top wall 14 and having screws 84, 86 and 88, 90 carried in threaded holes therein, and second sections 92, 94 having slotted openings to receive the screws, the sections 80, 92 being adjustably slidable with respect to one another and the same being true of the sections 82, 94. As a result, within limits, a single convection unit can be employed with different sized fireplaces without major modifications to the unit. It can be seen that the wing 78 is interposed between the fire area which has the logs and coals, and the blower 28. This serves as radiant-heat shield or interceptor to block radiant energy which would otherwise impinge upon the casing of the blower and possibly cause damage thereto, and constitutes another important feature of the invention.

Another embodiment of the invention is illustrated in FIGS. 6–8, showing a slightly modified, forced-draft convection grate unit 12*a* employed with a stove housing or hood 100 and chimney 134 so as to function as a complete stove. The unit 12*a* is substantially idential to the unit 12, except that feet 102 have been added to the latter, and the wings 76, 78 removed from the unit 12. The modified device comprises upstanding heat exchanger plates 18*a*, 20*a*, 22*a* and 24*a*, and nozzles 40*a*, 42*a*, 44*a*, 46*a* and 48*a* for directing heated air from the interior of the unit to the room. A blower 28*a* effects flow of air through the grate, as in the previous embodiment.

The stove housing 100 includes doors 104, 106 which are carried by means of hinges 107. As particularly shown in FIG. 8, the housing is provided with outer walls 110, 112, and 114, and inner walls 111, 113 and 115, the outer and inner walls forming channel-like spaces or passages 117 therebetween. As shown in FIG. 8, these passages are closed off at the top of the stove by a slotted plate 118, and a blower 119 directs air from the room upward through the passages, to be heated by contact with the inner walls 111, 113, 115. A series of radiator pipes 124, 126, 128, 130, 132 is mounted adjacent and under the plate 118, and each pipe has one end in communication with the rear passage 117. A series of heat conducting fins 129 is carried by the pipes 124–132, to extract heat from the flame, gasses and smoke of the fire. The smoke and gasses are channeled through an elongate aperture 121 in the plate 118, and up through the chimney 134. The latter includes a damper 136 of usual construction. By such an arrangement it can be seen that the fire and smoke are completely confined in the housing 100. Air from the room is forced into one side passage 117 by the blower 119, forced through the pipes 124–132 and back into the room. The air is heated by engagement with the inner walls 111, 113, 115 as well as during its travel through the pipes 124–132. As a result, excellent heating efficiency is obtainable.

The area containing the pipes 124–132 is termed a "heat-exchanging head or top zone" of the stove, being bounded by the top plate 118, manifold wall 115 and upper portions of the back wall 114 and side walls 110, 111, 112 and 113.

The above construction is seen to have the advantage that, since both the blowers 28*a*, 119 are disposed outside the housing 100, they run extremely cool and are thus not susceptible to failure from overheating. In addition, the outer walls 110, 112, 114 are separated from the area of the flame, and thus will not be of such high temperature as to cause burns in the event that a person inadvertently comes in contact with them.

FIG. 9 illustrates a modified form of the invention wherein a convection grate unit 12*b* is shown, comprising a low, rectangular, generally flat enclosure having top and bottom walls 14*b*, 16*b* respectively and a plurality of upstanding heat collecting supports 18*b*, 20*b*, 22*b* and 24*b*. In accordance with the invention, the supports 18*b*–24*b* are hollow, and the interior portions communicate with the interior of the enclosure through corresponding slots 138. The enclosure includes an inlet port 26*b* and outlet ports similar to those of the unit of FIGS. 1–5. The supports 18*b*–24*b* are preferably welded in slots in the top wall 14*b*, and are seen to have concave upper edge portions 140, 142, 144, 146 respectively for cradling the logs being burned, as in the first embodiment. The above construction is seen to have the same advantages of the first embodiment, in that there is available on the enclosure and the log supports a large surface area for contact with the coals of the fire. By virture of the supports being hollow, additional surface is provided, improving the heat conduction from the coals to the circulating air.

Another embodiment of the invention is illustrated in FIG. 10, which discloses a convection grate unit similar to that of FIGS. 1–5 but adapted to utilize water as the circulating medium. Components similar to those already described above in connection with FIGS. 1–5 have been given similar reference numerals. In place of the air impeller 28 and air discharge ports 40–48 previously described, the embodiment of FIG. 10 utilizes the pair of water fittings 140 which are secured to opposite end portions of the grate unit 12. Attached to the fittings 140 are forwardly extending pipe sections and elbows 142, in turn connected with pipe lengths 144 which are adapted to extend in opposite directions over the hearth of the fireplace and to the adjoining floor areas. Connecting pipes 146 can pass through the floor, and are joined to the sections 144 by elbows as shown. The pipes 146 connect with pipes 148 which lead to and form a hot water furnace and pump unit designated generally by the numeral 150. The pipes 146, 148 although shown as joined by elbows, can be replaced by any conventional circulating hot water pipe configuration between the pump and furnace unit 150 and the pipe sections 144. Circulating water is forced through the grate unit 12 by the furnace and pump 150, and is heated by the plates 50–56 located within the enclosure 12.

Figure 11:
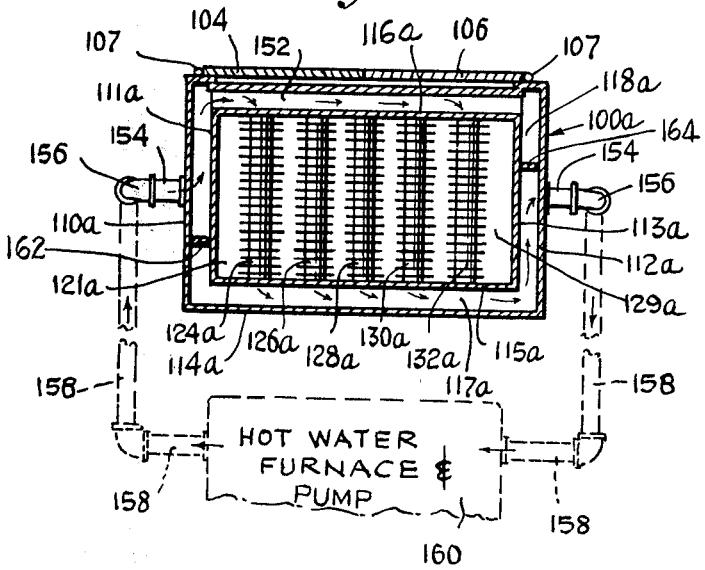
FIG. 11 is a horizontal sectional view of a stove adapted to utilize water as the circulating medium, constituting yet another embodiment of the invention.

A circulating-water type stove unit is illustrated in FIG. 11, wherein parts similar to those already described above in connection with FIGS. 6–8 have been similar reference numerals. In place of the air impeller 119 and air discharge ports 124–132 of FIGS. 6–8, the stove structure of FIG. 11 has water fittings 154 connected to the housing walls 110*a* and 112*a*. The fittings 154 are connected with downwardly extending pipe sections and elbows 156, which are joined to rearwardly extending pipes 158 shown in broken outline. The pipes 158 can be connected with the hot water piping of a furnace and pump installation 160 in the dwelling.

Vertical baffles or partitions 162, 164 are disposed respectively between walls 110*a*, 111*a* and 112*a*, 113*a* so as to divide the interior of the housing into two separate areas. Finned heat exchange pipes 124*a*, 126*a*, 128*a*, 130*a*, 132*a* have their ends connected to and communicating with manifold structures comprising walls 115*a*, 116*a* which define distribution passages 117*a* and 152, the latter being located at the top of the stove below the top baffle plate 118 whereas the chamber 117*a* extends vertically and horizontally for the height and width of the stove at the rear thereof. The vertical baffles 162, 164 make the water flow as designated by the arrows, whereby it is forced from front to rear through all of the finned tubes 124*a*–132*a*. The area containing the heated water constitutes a water jacket at the sides and rear of the stove, whereas the passage 152 is a horizontal manifold area located above and to the rear of the tops of the doors 104, 106. The forced circulation of water is effected by the pump of the furnace unit, as will be understood.

Thus, it is seen that the improved convection unit of the invention as illustrated in FIGS. 10 and 11 is adapted for use with a water medium, thereby supplementing the existing hot water system of a dwelling or providing heat to independent radiators (now shown) disposed at desired locations.

Yet another embodiment of the invention is illustrated in FIGS. 12–16, which depict a grate means 168 comprising a tight enclosure having a corrugated sheet metal top wall 170, a flat sheet metal bottom wall 172, front and rear sheet metal walls 174 and 176 respectively, and sheet metal side walls 178.

The enclosure 168 has an inlet port 180 and outlet ports 182 including forward-extending pipes 184.

The corrugation ribs 186 and 188 provide a surface of appreciable area or expanse, both outside and inside of the enclosure, which results in a high rate of heat exchange and efficiency.

Means in the form of a blower 190 is connected to the inlet port 180 to supply pressurized fluid to the same. The outlet ports 182 are adapted to direct heated air away from the enclosure 168, in this case forwardly thereof.

Coals from the fire rest in the valleys 192 of the top plate 170. The front wall 174 has a scalloped top edge 194 which conforms to the corrugated configuration of the top wall 170 and is secured thereto. Also, it has the ports or openings 182, in which are secured the forward-extending pipes 184.

To cradle logs and prevent their rolling off the front portions of the top wall 170, the ribs 186 have attached to them abutment members 198.

The deeply corrugated configuration of the to wall 170 gives the effect of compartments in the enclosure, and tends to distribute the air more evenly therein, providing improved heat transfer.

In the appended claims, the bottom wall 16 of the grate structure in FIGS. 1–5 is also referred to as "a fluid-cooled wall of appreciable expanse which is shielded from the fire", and the same is true of the walls 110, 112 and 114 in FIGS. 6–8, and 172 in FIGS. 12–16.

From the above it can be seen that I have provided novel and improved forced fluid heat units adaptable for use in fireplaces or as a wood burning stove, said units being simple in construction and exhibiting high efficiency from the standpoint of removing the maximum possible heat from a fire. The devices are rugged and virtually maintenance free, and represent a distinct advance and improvement in the technology of heat extraction systems.

Variations and modifications are possible without departing from the spirit of the invention.

I claim:

1. A high-efficiency heating unit for extracting heat from a fire, comprising in combination:

(a) means providing a stove enclosure which is to enclosure a fire and to be subjected to heat therefrom, (b) said enclosure having spaced fluid-cooled walls of appreciable expanse, which surround and are shielded from the fire, (c) said enclosure having a fluid inlet port adjacent its bottom and having fluid outlet ports adjacent its top, (d) means connected to the fluid inlet port for supplying pressurized fluid to the space between said walls, (e) said fluid outlet ports being adapted to direct heated fluid away from the enclosure, (f) grate means connected to the bottom of the enclosure and adapted to hold logs and coal, (g) said grate means having spaced-apart top and bottom walls constituting a second enclosure, (h) said second enclosure having a fluid inlet port, and having outlet ports at its front, (i) means connected with the inlet port of the second enclosure for supplying pressurized fluid to the same, (j) said fluid outlet ports of the second enclosure being adapted to direct heat fluid forward and away from the same, (k) said stove enclosure and said second enclosure constituting separate and independent chambers whereby the pressurized fluids therein do not intermix with each other, (l) the upper wall of said second enclosure having means extending toward the top of the stove enclosure providing an increased surface area to the fire.

2. The invention as defined in claim 1, wherein:

(a) said surface-area providing means comprises a plurality of spaced-apart heat-collector plates secured to the upper wall and extending upwardly therefrom, for intimate contact with coals, (b) said heat-collector plates having scalloped top edges for cradling logs placed thereon.

3. The invention as defined in claim 1, wherein:

(a) the said upper wall of the second enclosure has a corrugated configuration, so as to present a large area of contact with coals.

4. The invention as defined inclaim 1, and further including:

(a) a plurality of heat-dissipating plates disposed inside the second enclosure and secured to the upper wall thereof, said heat dissipating plates being spaced apart from one another and adapted for intimate contact with the fluid passing through the second enclosure, to thereby supply heat thereto, (b) said plates being of solid configuration.

5. The invention as defined in claim 1, and further including:

(a) a plurality of heat-dissipating plates disposed inside the second enclosure and secured to the upper wall thereof, said heat dissipating plates beng spaced apart from one another and adapted for intimate contact with the fluid passing through the second enclosure, to thereby supply heat thereto, (b) said plates being of hollow configuration.

6. The invention as defined in claim 1, wherein:

(a) the said upper wall of the second enclosure has a corrugated configuration, so as to present a large area of contact with the coals, and (b) abutments carried at the peaks of the corrugations, for preventing logs from rolling forwardly and off the said upper wall.

7. The invention as defined in claim 1, and further including:

(a) means connected with the outlet ports of the second enclosure for channeling heated fluid forwardly of the same, (b) said immediately-preceding means comprising hollow pipes connected with the interior of the second enclosure and extending beyond the front wall portion thereof and into the room.

8. The invention as defined in claim 1, wherein:

(a) said second enclosure has within it a series of spaced-apart heat-dissipating plates secured to the upper wall thereof and constituting baffles to channel fluid from the inlet port throughout diverse areas of the enclosure interior and out through the outlet ports thereof.

* * * * *